US006536636B1

(12) United States Patent
McDonniel

(10) Patent No.: US 6,536,636 B1
(45) Date of Patent: Mar. 25, 2003

(54) SUPPORT HOSE APPLICATOR

(76) Inventor: Thomas B. McDonniel, 5575 Coit NE., Grand Rapids, MI (US) 49525

( * ) Notice: Subject to any disclaimer, the term of this patent is extended or adjusted under 35 U.S.C. 154(b) by 0 days.

(21) Appl. No.: 09/994,223

(22) Filed: Nov. 26, 2001

(51) Int. Cl.[7] ..... A47G 25/80
(52) U.S. Cl. ..... 223/111; 223/112
(58) Field of Search ..... 223/111, 112

(56) References Cited

U.S. PATENT DOCUMENTS 3,968,792 A * 7/1976 Small ..... 128/856
4,153,054 A * 5/1979 Boone ..... 128/856
4,934,382 A * 6/1990 Barone, Jr. ..... 128/844

* cited by examiner

*Primary Examiner*—John J. Calvert
*Assistant Examiner*—James Smith
(74) *Attorney, Agent, or Firm*—Waters & Morse, P.C.

(57) ABSTRACT

A support hose applicator and method for applying and removing elastic tubular material from a limb of a patient comprises a resiliently expandable support ring having rotatable sidewalls, and a mandrel with elongated sidewalls on which the support ring fits. The hose or tubular material is applied to a patient by first pulling an open end of the hose over the mandrel. The support ring is then placed over the hose and mandrel. The hose is then rolled onto the support ring as the support ring is rolled along the mandrel. The hose is applied to a patient by rolling the support ring along the limb of the patient while holding a free end of the hose in place. The support ring comprises a plurality of ring segments rotatably mounted on a resiliently expandable band that is expandable to make the ring larger.

17 Claims, 8 Drawing Sheets

SUPPORT HOSE APPLICATOR

BACKGROUND OF THE INVENTION

Elastic support hose and other tubular elastic materials are applied to the limbs of persons in order to provide various levels of support for a variety of purposes. Examples of support hose are so-called T.E.D. hose, Jobst stockings, and compression stockings.

Elastic support hose and other tubular elastic materials are sometimes difficult to apply to the limbs of patients. Typically, such materials are relatively tight and difficult to slide over a limb. This is especially true when a limb is swollen, which is frequently present when support hose is used. Moreover, sliding an elastic tube over a limb can be abrasive and can cause pain or aggravate an injury.

One way of applying hose to a limb is to roll the hose into a coil from the open end of the hose toward the toe and then unroll the coil from the toe of the person upwardly along the limb. A difficulty with tight support hose is that as the support hose is rolled up into a coil, the aperture in the coil becomes smaller and smaller, and the support hose, when coiled, is not sufficiently expandable to permit the support hose to be fitted over the limb of the patient.

An object of the present invention is to provide an improved method and apparatus for applying and removing tubular elastic materials from a patient.

SUMMARY OF THE INVENTION

In accordance with the present invention, a support hose applicator and method for applying elastic tubular material to a limb of a patient comprises a support ring having rotatable sidewalls on which the hose can be rolled. Desirably, the ring comprises a plurality of ring segments rotatably mounted on a resiliently expandable band that is expandable to make the ring larger. The support ring fits over elongated sidewalls of a compatible mandrel. Hose is rolled on the ring by folding an open end of the hose over the ring and then rolling the ring along the mandrel. The separate ring segments permit the sidewalls of the ring to roll, while the expandable band permits the ring to expand as the hose is rolled up on the mandrel. The expansion of the ring allows the interior opening in the rolled hose to be maintained at the same diameter as the exterior of the mandrel.

DETAILED DESCRIPTION OF PREFERRED EMBODIMENT

Figure 1:
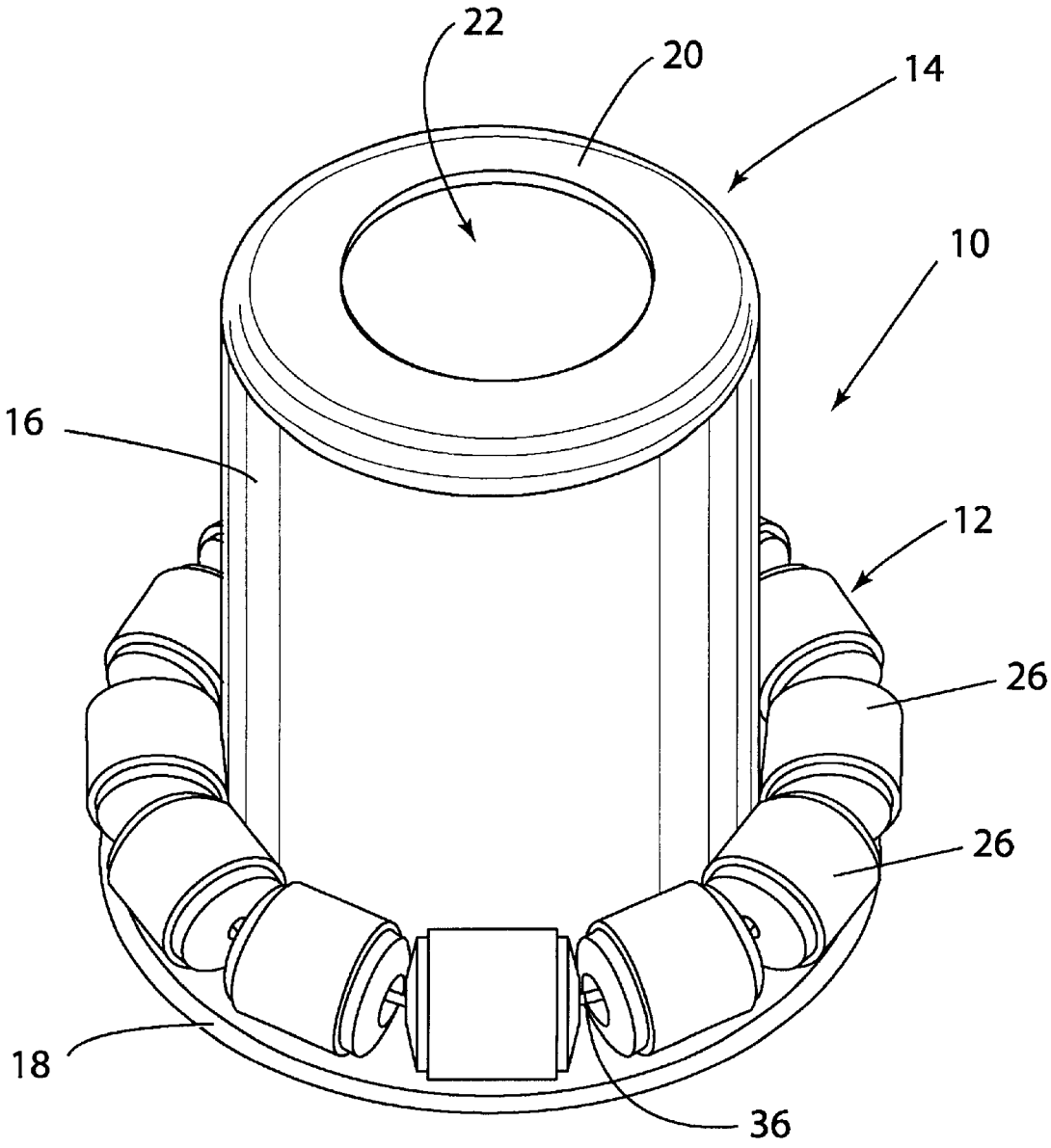
FIG. 1 is a perspective view of the support hose applicator of the present invention.
Figure 2:
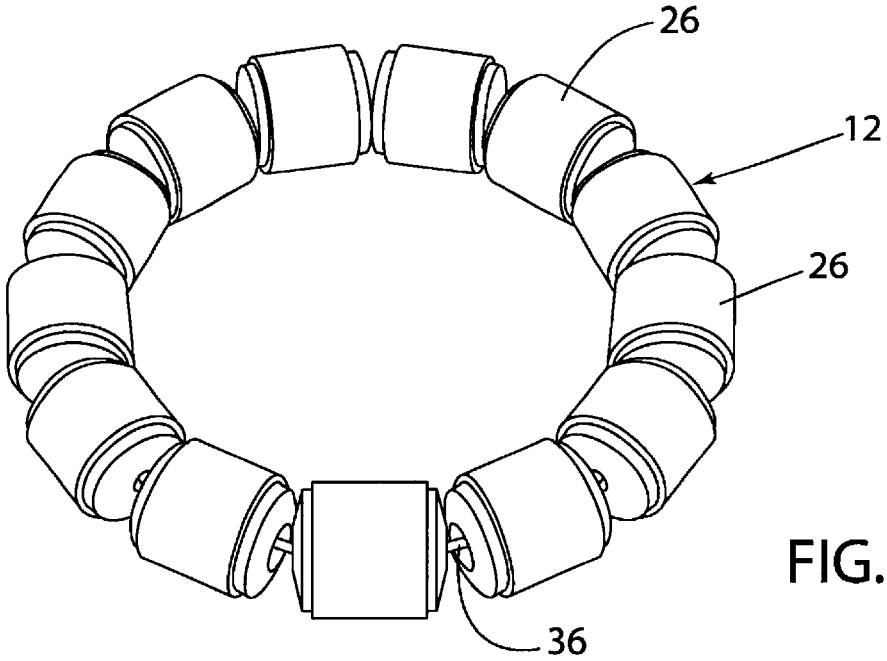
FIG. 2 is a perspective view of support ring of the present invention.
Figure 3:
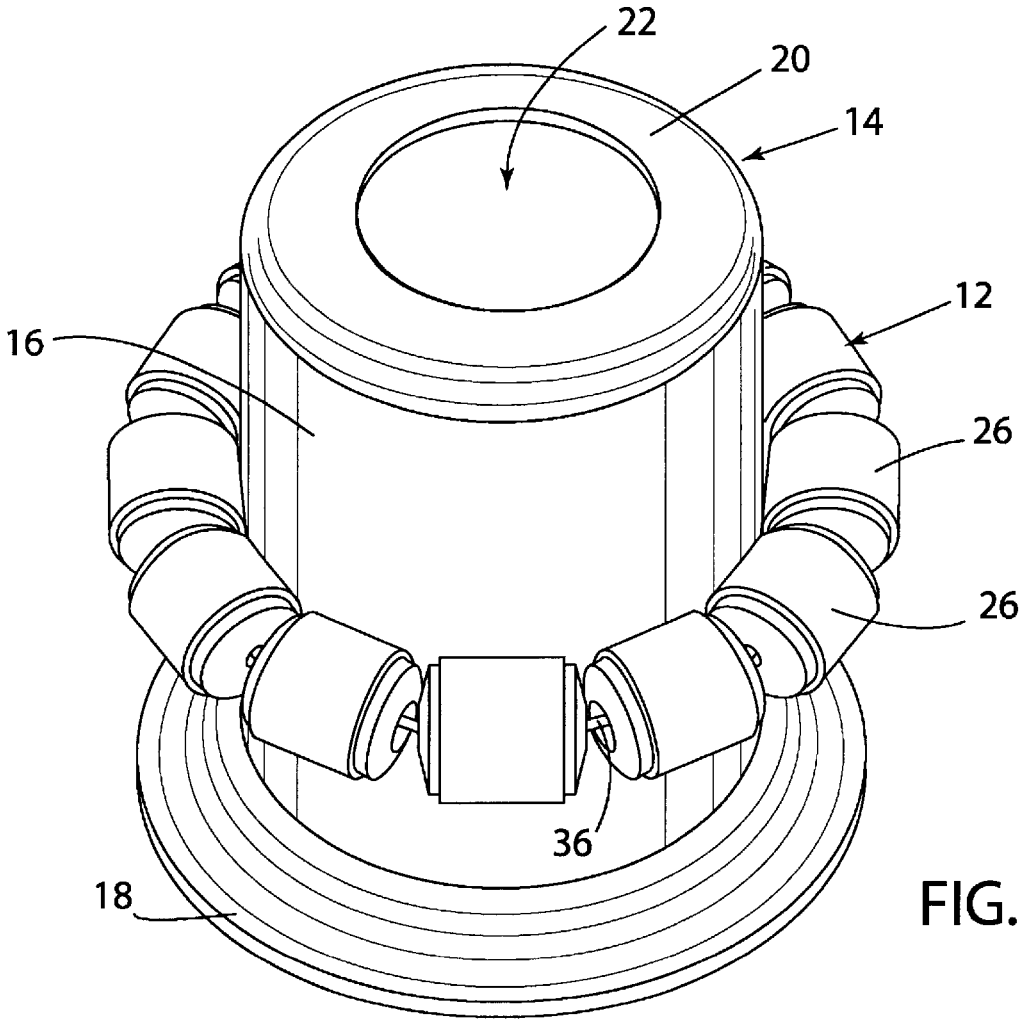
FIG. 3 is a perspective view showing support ring being applied to the mandrel of the present invention.
Figure 6:
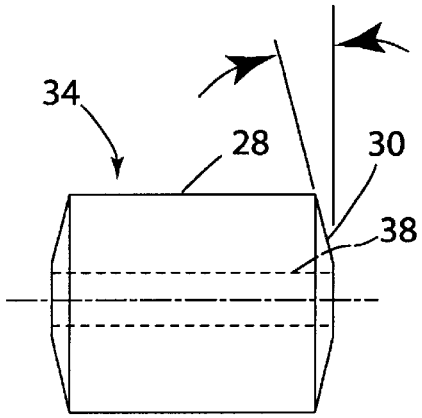
FIG. 6 is a side elevational view of a second embodiment of a ring segment of the present invention.
Figure 5:
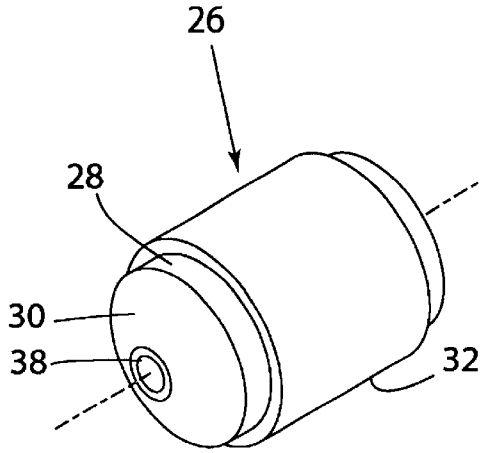
FIG. 5 is a perspective view of one ring segment of the present invention.
Figure 4:
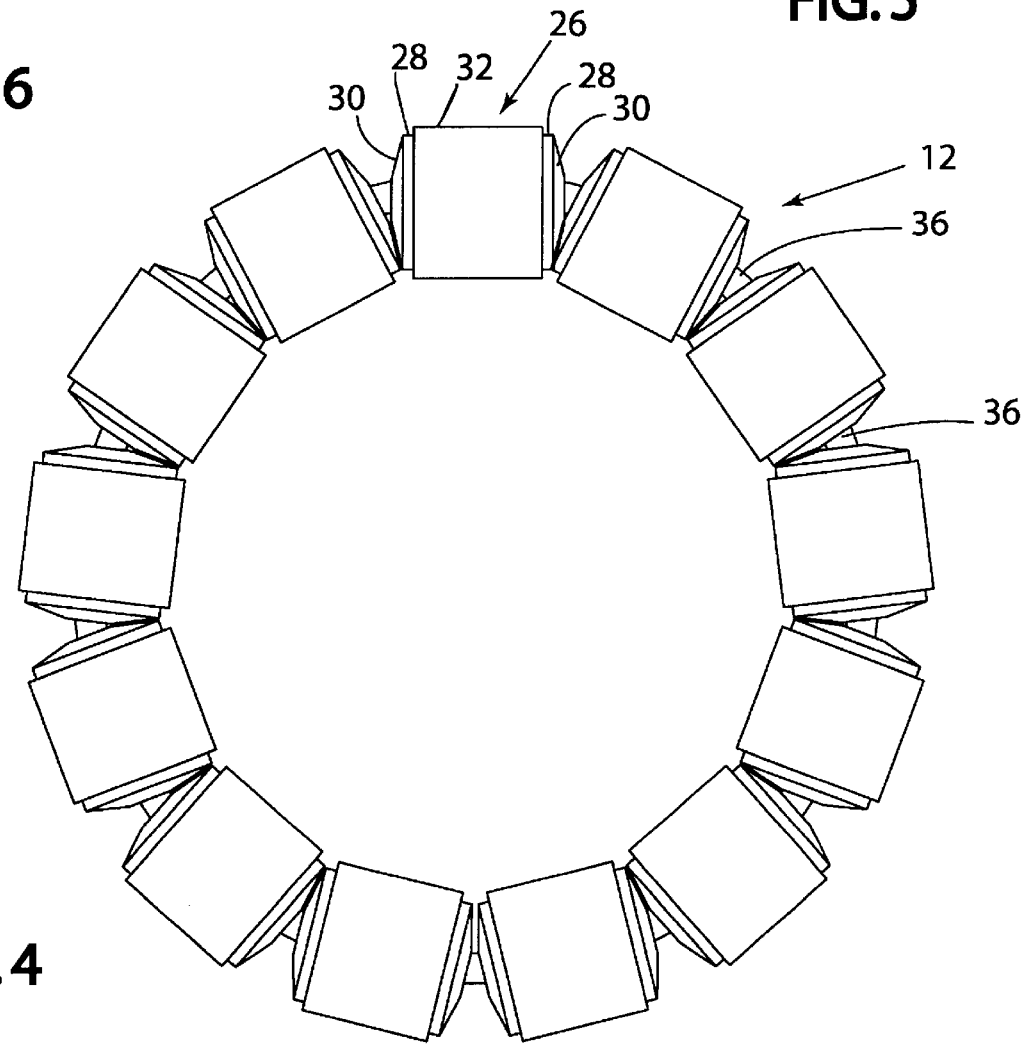
FIG. 4 is a plan view of the support ring of the present invention.

Referring to the drawings, a support hose applicator 10 constructed in accordance with the present invention comprises a rotatable and expandable support ring 12 that is mountable on an elongated mandrel 14 having an elongated outer sidewall 16 and having a rim 18 at one end thereof. The sidewall preferably is generally circular in cross section, but this is not necessarily required. The sidewall can be cylindrical or can be tapered somewhat in a frustro-conical shape. A slightly tapered shape is desirable from a manufacturing standpoint.

Figure 7:
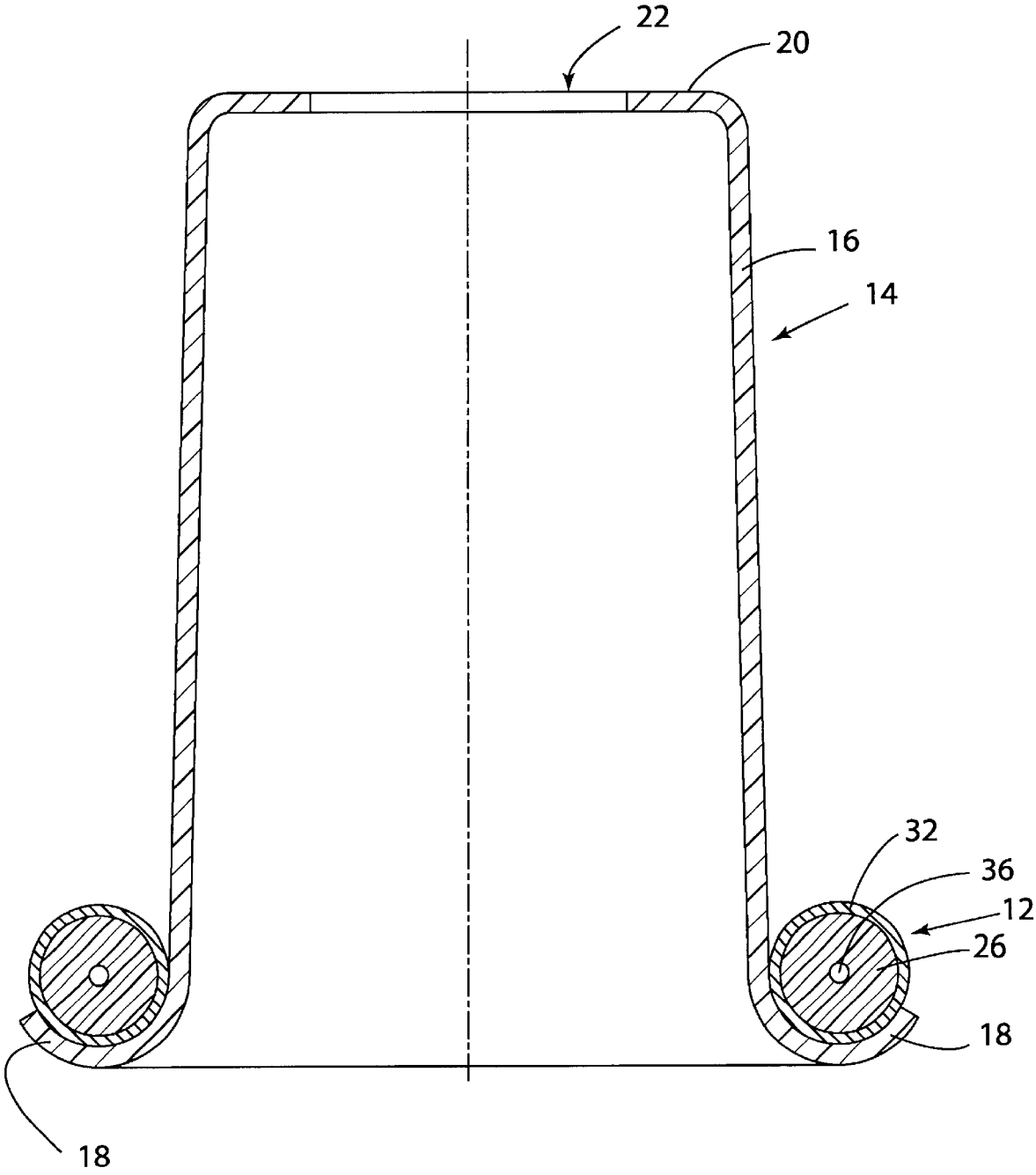
FIG. 7 is a sectional side view of the mandrel of the present invention showing the application of the support ring thereon.
Figure 8:
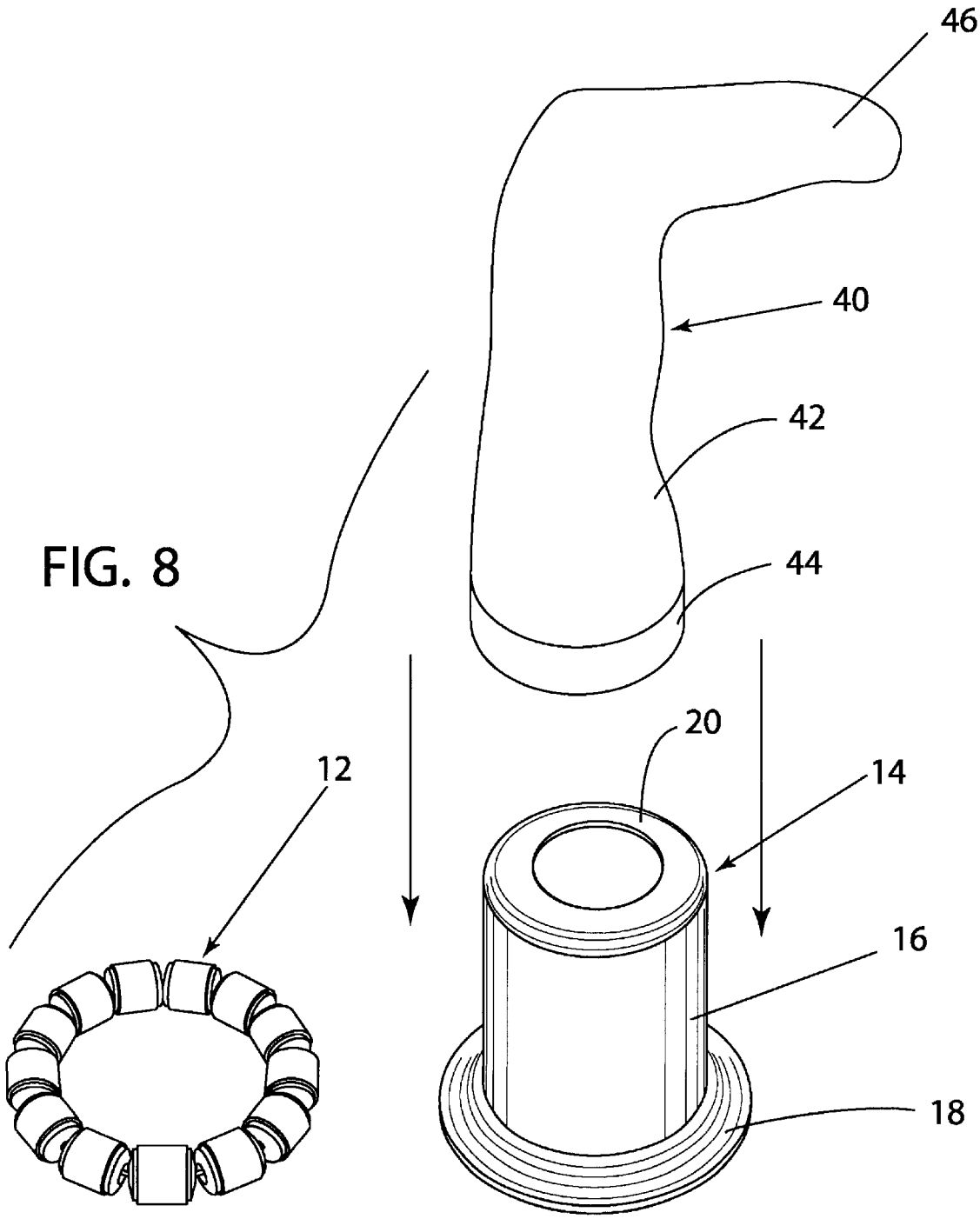
FIG. 8 is a pictorial perspective view showing the application of support hose to the mandrel, as a first step in preparing the support hose for application to a user.

Mandrel 14 can be formed of any suitable material. In the illustrated embodiment, the mandrel is a molded plastic material formed in a generally tubular shape with an inner or upper end 20 being partially closed and having an opening 22 therein. Rim 18 is formed at an outer or lower end 24 of the mandrel. Rim 18 has an upwardly facing arcuate configuration that is designed to receive therein expandable support ring 12, as shown in FIGS. 1 and 7.

In the preferred practice of the present invention, a mandrel design suitable for knee high T.E.D. hose or other hose, is desirably formed with an outer diameter of approximately 3½ inches at the lower end and a slightly smaller diameter at the upper end. The mandrel can be any desired length, but is conventionally about six inches long.

Figure 9:
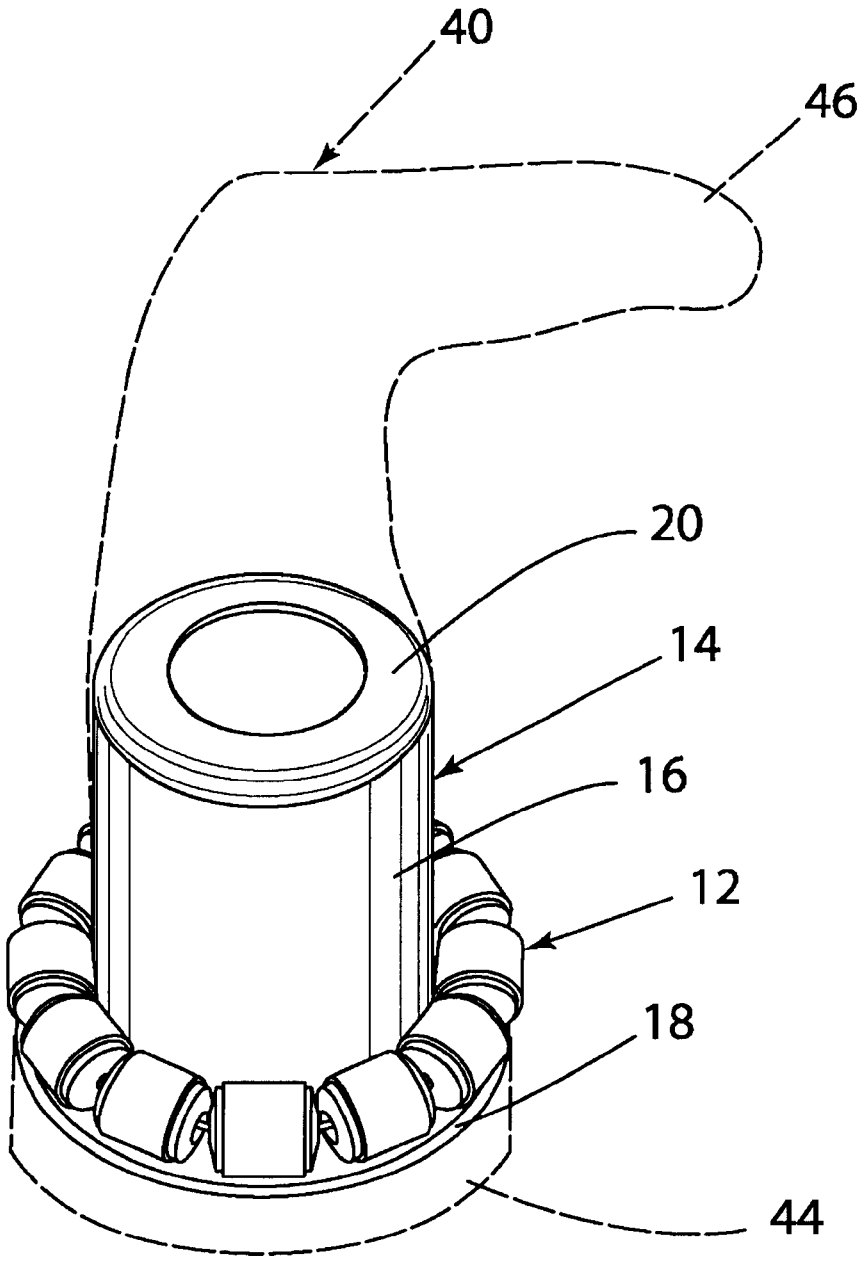
FIG. 9 is a perspective view showing the application of the support ring over the mandrel and support hose in order to roll the support hose on the support ring.
Figure 10:
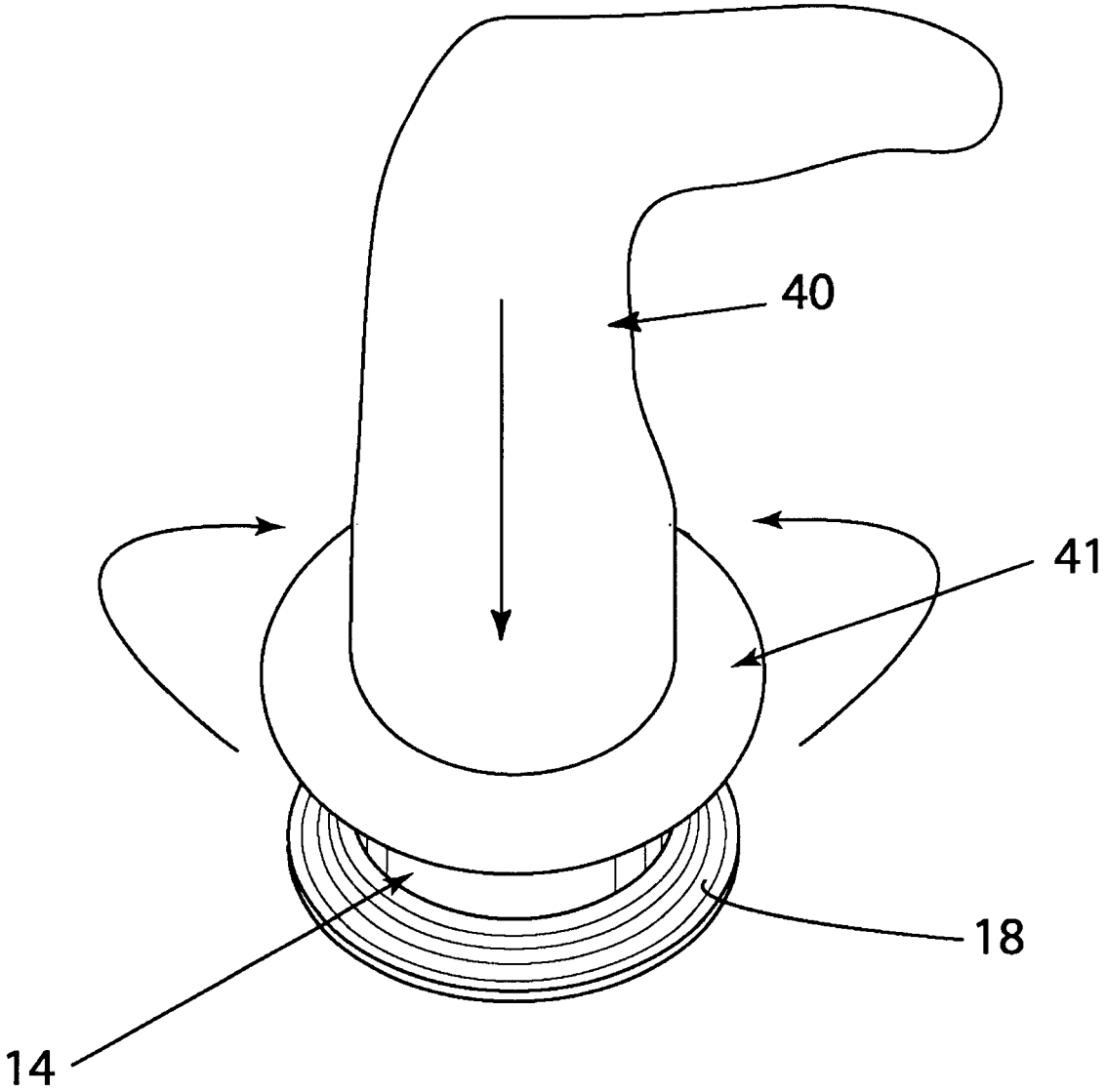
FIG. 10 is a perspective view showing the hose of FIG. 5 being rolled on the support ring.

Support ring 12 is formed of a plurality of spool shaped ring segments 26 having generally cylindrical sidewalls 28 and beveled ends 30. The ring segments desirably are formed of a molded plastic material but could be formed of any suitable material. An exterior layer of tubular material 32 can be applied to the outer sidewalls 28 of the ring segments in order to provide a softer, more tacky exterior, if desired. However, it is preferred that the ring segments themselves have outer sidewalls that are formed of a material that is sufficiently soft and tacky that the tubular material 32 is not necessary. A ring segment 34 having no outer layer is shown in FIG. 9.

Ring segment 34 (or ring segment 26 with tubular layer 32) desirably is about three quarters of an inch in diameter and about one inch long. The diameter of the ring segments and the length of the ring segments can vary. Under some circumstances, a ring segment greater than one inch in diameter in a 3½ diameter ring can be too thick, such that the opening in the rolled up stocking is too tight to fit over a foot. The various dimensions of the ring segments and ring and mandrel vary depending upon the nature of the elastic material and the size of the limb on which the material is to be applied.

Desirable materials for the ring segments are vinyl or a material with similar characteristics. It is desired to have the exterior surface as soft as possible and as tacky as possible so that the ring segments will cling to the hose as the hose is rolled on the ring. If a separate tubular material 32 is applied to the exterior surface of the ring segments, the tubular material can be rubber or the like and can be 1/16 inch or so thick. In such a case, the overall dimension of the ring segments would take into account the tubular layer on the exterior of the ring segments.

The ring segments are connected together in a ring by means of a resiliently expandable band 36 that fits through axial openings 38 in the ring segments. Band 36 desirably is formed of latex rubber tubing. Tubing having a 1/8 inch outer diameter and commercially available as so-called surgical tubing has been found to be quite satisfactory. Such tubing has a 4000 psi tensile strength and stretches elastically to about 350% of its original length. Thus, a cord having an unstretched length of about 12 inches may stretch to almost four feet in length.

When the ring segments are mounted on band 36 and the band is formed in a ring, the inside diameter of the ring is about the same as the outside diameter of the mandrel, so that the ring fits easily over the mandrel. The ring can be made a slightly smaller diameter so that it expands somewhat in fitting over the mandrel.

The outer ends 30 of the ring segments are beveled, so that when the segments are formed in a ring, the beveled surfaces substantially mate. A bevel angle of approximately 12½ degrees is satisfactory for a 3½ inch interior diameter ring. This angle can vary with the diameter of the ring.

With the ring constructed in this manner, it can be seen that the ring segments are individually rotatable on the expandable band, and each ring segment will roll along the mandrel as the ring is moved between the top and the bottom of the mandrel.

The support ring and mandrel are used in connection with the application of support hose on the limb of a patient in the manner shown in FIGS. 8–12. For exemplary purposes, the tubular material being applied to a patient is illustrated as support hose 40. It should be understood that other types of elastic tubular material could be employed. Support hose 40 comprises an elongated tubular body 42 formed of elastic tubular material having an open end 44 at one end and having a closed end 46 at the other end, with the closed end being formed in the shape of a foot. Alternatively, end 46 could be open.

To apply support hose 40 to a patient, the open end 44 of the support hose is first pulled downwardly over the top of the mandrel and pulled over the rim 18 at the bottom of the mandrel (FIG. 9). The mandrel is formed of a plastic material that is sufficiently non-tacky to permit the hose to be slid downwardly over the mandrel sidewalls.

After the hose has been mounted on the mandrel, the expandable support ring is placed over the hose and the mandrel and is moved down to the bottom of the mandrel (FIG. 9). The open end of the support hose is then folded over the support ring and the support ring is thereafter rolled upwardly along the mandrel until it reaches the upper end of the mandrel. The rotatable ring segments let the ring rotate easily in order to roll the hose thereon. At that point, the support ring and rolled support hose thereon 41 are slid (without rolling) downwardly on the mandrel to the bottom of the mandrel. The ring is then again rolled upwardly along the mandrel to the top of the mandrel, with the support hose being rolled on the ring. This operation is repeated until the entire hose has been rolled onto the ring. As the support hose is rolled on the support ring, the interior diameter of the opening in the ring of rolled material continues to be maintained at a diameter equal to the outer diameter of the mandrel. In order to do this, the elastic material is stretched and the diameter of the expandable support ring is expanded. Thus, when the entire stocking is rolled onto the support ring, the ring has been formed with an enlarged interior opening that is sufficiently large to fit over a desired limb of a patient. In a typical patient to which knee high T.E.D. hose is being applied, a 3½ inch mandrel and 3½ inch interior diameter expandable ring will produce a roll of stocking having a sufficiently large interior opening that the stocking can be applied over the foot and leg of a user.

Figure 11:
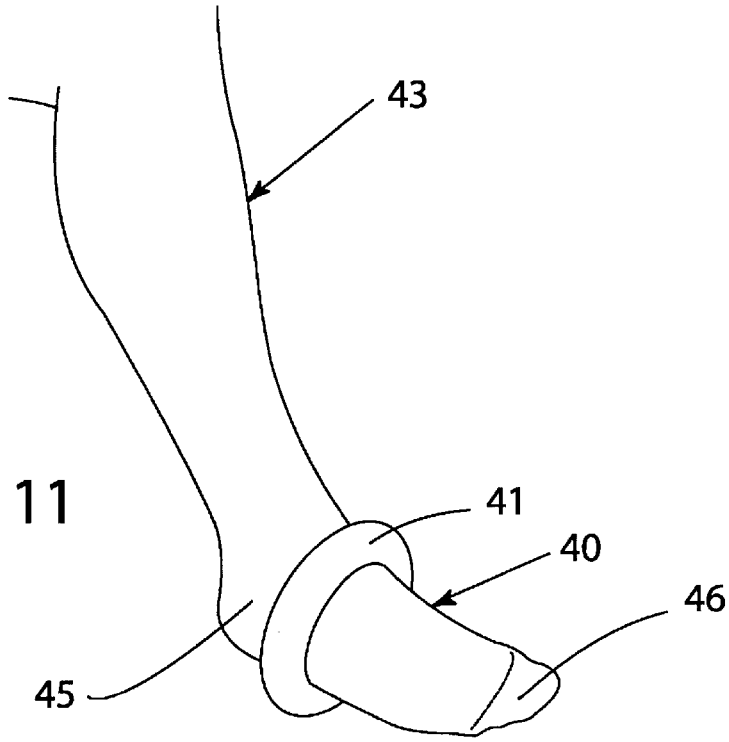
FIG. 11 is a perspective view showing the application of the rolled-up hose on a persons' foot.
Figure 12:
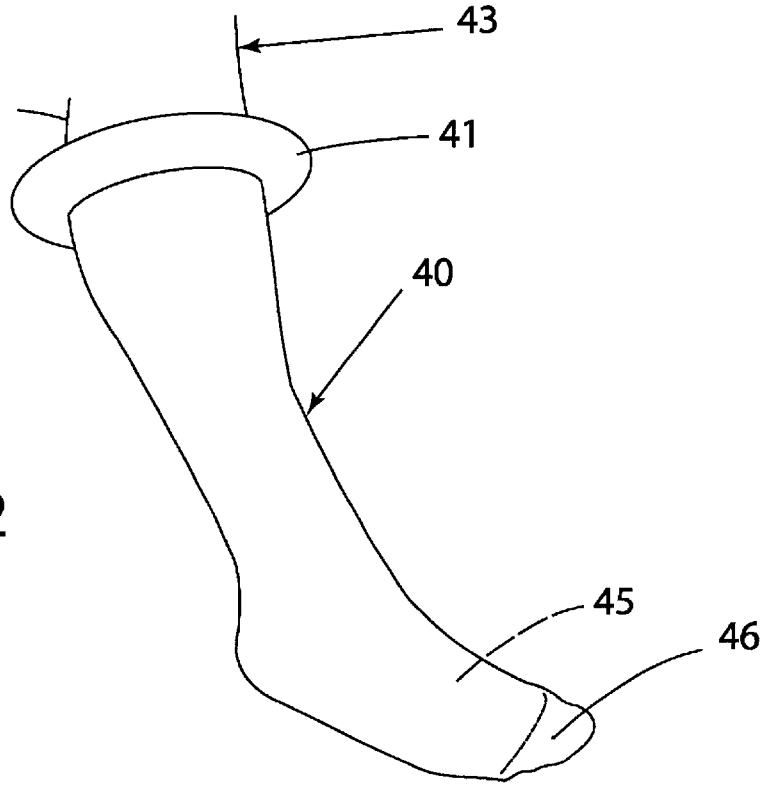
FIG. 12 is a perspective view showing the continued application of the hose over the leg of a person.

The manner in which the rolled tubular material is applied to a person's limb employing the hose applicator of the present invention is shown in FIGS. 11 and 12. The application of a stocking to a leg is illustrated. As shown in FIG. 11, to apply a stocking to a limb 43 after it has been rolled onto the support ring, the limb (the person's foot 45) is inserted in the opening in the support ring and the support ring is then rolled onto the limb (leg 43), causing the support hose to be applied along the limb as the support ring is rolled along the limb. When the hose has been applied and the ring is free of the hose, the ring can then be moved downwardly over the hose and removed from the limb.

To remove hose from the limb, the top of the hose is generally folded over and pulled downwardly over the hose and limb. Alternatively, the support ring can also be employed for this purpose. To do this, the ring is inserted on the limb over the hose and moved to the open end of the hose. The hose is then folded over the ring and the ring is rolled downwardly toward the end of the limb, rolling the hose on the support ring as the support ring is rolled along the limb. The support ring and hose are then removed from the end of the limb when the hose is rolled on the ring.

As stated above, various materials can be employed for the ring and the mandrel and various sizes can be employed for different types and diameters of elastic material and different sizes of limbs.

The present invention makes it possible to apply and remove support hose and other tight elastic materials form a limb of a user easily, quickly and simply, and without causing pain or discomfort. Damage caused by pulling tubular material over a limb, particularly one that has been damaged is avoided.

I claim:

1. A support hose applicator for applying and removing elastic tubular material from a limb of a patient comprises a resiliently expandable support ring having rotatable sidewalls, the support ring having a contracted size wherein elastic tubular material of a predetermined diameter may be rolled onto the support ring on rotation of the ring sidewalls, the support ring having an expanded size wherein the ring and elastic tube rolled thereon are enlarged sufficiently such that the ring can be rolled over a predetermined limb of a patient to unroll the elastic tubes onto the limb.

2. A support hose applicator as in claim 1 wherein the ring comprises a plurality of ring segments rotatably mounted on a resiliently expandable band that is expandable to make the ring larger.

3. A support hose applicator as in claim 2 wherein the ring segments have generally round outer contours and an axial opening therethrough for mounting of the segments on the expandable band.

4. A support hose applicator as in claim 3 wherein the expandable band comprises an elastic cord formed in the shape of a closed loop.

5. A support hose applicator as in claim 3 wherein the ring segments have opposed axial ends that are contoured so as to permit angular engagement of opposed axial ends when they are formed into an annular ring.

6. A support hose applicator as in claim 3 wherein axial ends of at least some of the ring segments are inclined inwardly as the end surfaces extend radially from the axial center to the outer periphery of the ring segments.

7. A support hose applicator as in claim 3 wherein the length of the ring segments in an axial direction is greater at the axial center than at outer peripheral edges of the segments.

8. A support hose applicator as in claim 1 and further comprising a mandrel by which elastic tubular material can be rolled on the support ring, the mandrel having an elongated, axially extending surface that fits inside the support ring at least when the support ring is expanded, the exterior surface permitting the support ring to be rolled along the exterior surface with an end of the tubular material thereof so as to roll the tubular elastic material up on the support ring.

9. A support hose applicator as in claim 8 wherein the mandrel has a generally cylindrical or conical exterior surface.

10. A support hose applicator as in claim 8 wherein the mandrel has an outwardly extending flange at a distal end that restrains the support ring from rolling over that end of the mandrel.

11. A support hose applicator as in claim 9 wherein the mandrel exterior surface has the form of a truncated cone.

12. A support hose applicator as in claim 1 wherein the elastic tubular material is support hose and the limb is at least part of a patient's lower leg and foot.

13. A support hose applicator for applying and removing elastic tubular material from a limb of a patient comprises a support ring having rotatable sidewalls on which the hose can be rolled, the ring comprising a plurality of ring segments rotatably mounted on a band that retains the segments in the form of a ring, the ring segments having round outer contours and an axial opening therethrough for mounting of the segments on the band.

14. A support hose applicator as in claim 13 wherein the band is expandable and comprises an elastic cord formed in the shape of a closed loop.

15. A support hose applicator as in claim 14 and further comprising an elongated mandrel on which the hose is rolled, the mandrel having an elongated outer surface on which an open end of the tubular material is mounted, the support ring fitting over the material and mandrel, the material being folded over the ring and rolled on the ring by rolling the ring on the mandrel.

16. A method of applying a tubular elastic material to a patient's limb comprising:

providing an expandable support ring having rotatable sidewalls;

rolling the elastic material onto the ring;

inserting the limb into the support ring;

unrolling the elastic material onto the limb by rolling the ring along the limb with a free end of the tubular material in a fixed position on the limb so as to unroll the tubular elastic material along the limb; and removing the support ring from the limb after the elastic material has been unrolled on the limb.

17. A method as in claim 16 wherein:

the tubular elastic material is rolled on the support ring by first pulling a distal end of the material over an elongated exterior surface of a mandrel;

placing the support ring over the tubular material on the mandrel;

rolling the tubular material on the support ring, starting with placement of the distal end of the tubular material on the support ring and rolling the support ring toward a proximal end of the tubular material;

whenever the support ring is rolled to a position adjacent a proximal end of the mandrel before the tubular material has been rolled up to the extent desired, sliding the support ring and attached portion of the tubular material back to a distal end of the mandrel and then recommencing to roll more tubular material on the ring by rolling the ring back toward the distal end;

removing the rolled up tubular material from the mandrel;

placing the desired limb in the center of the ring, holding an unrolled portion of the tubular material in position on the limb, and unrolling the tubular material along the limb; and removing the support ring from the limb.

* * * * *